US007370708B2

(12) United States Patent
Simpson et al.

(10) Patent No.: US 7,370,708 B2
(45) Date of Patent: May 13, 2008

(54) SEAL ARRANGEMENT

(75) Inventors: Neil Andrew Abercrombie Simpson, Aberdeen (GB); Alexander Craig Mackay, Aberdeen (GB); Robert Cowman, Perth (GB)

(73) Assignee: Weatherford/Lamb, Inc., Houston, TX (US)

( * ) Notice: Subject to any disclaimer, the term of this patent is extended or adjusted under 35 U.S.C. 154(b) by 335 days.

(21) Appl. No.: 10/902,694

(22) Filed: Jul. 29, 2004

(65) Prior Publication Data

US 2005/0057005 A1 Mar. 17, 2005

(30) Foreign Application Priority Data

Aug. 2, 2003 (GB) ..... 0318181.5

(51) Int. Cl.
*F16L 17/73* (2006.01)
*E21B 29/00* (2006.01)

(52) U.S. Cl. ..... 166/380; 166/207; 166/277; 166/384; 277/612; 277/615

(58) Field of Classification Search ..... 166/380, 166/207, 384, 277, 241.1; 277/338, 607, 277/612, 615
See application file for complete search history.

(56) References Cited

U.S. PATENT DOCUMENTS

| | | | | |
|---|---|---|---|---|
| 3,746,092 A | | 7/1973 | Land | |
| 4,771,828 A | * | 9/1988 | Cassity | 166/115 |
| 6,425,444 B1 | | 7/2002 | Metcalfe et al. | |
| 6,431,282 B1 | | 8/2002 | Bosma et al. | |
| 6,457,532 B1 | | 10/2002 | Simpson | |
| 2002/0033261 A1 | * | 3/2002 | Metcalfe | 166/285 |
| 2003/0047323 A1 | * | 3/2003 | Jackson et al. | 166/380 |
| 2003/0178204 A1 | * | 9/2003 | Echols et al. | 166/386 |
| 2004/0060706 A1 | * | 4/2004 | Stephenson | 166/380 |
| 2005/0172472 A1 | | 8/2005 | Verger et al. | |

FOREIGN PATENT DOCUMENTS

| | | |
|---|---|---|
| WO | WO 98/59151 A1 | 12/1998 |
| WO | WO 03/016669 | 2/2003 |
| WO | WO 03/060370 | 7/2003 |

OTHER PUBLICATIONS

GB Examination Report, Application No. GB041703.2, dated Jan. 30, 2006.
GB Search Report from British Application No. GB 0318181.5 Dated Nov. 21, 2003.

* cited by examiner

*Primary Examiner*—William P. Neuder
*Assistant Examiner*—Nicole Coy
(74) *Attorney, Agent, or Firm*—Patterson & Sheridan, L.L.P.

(57) ABSTRACT

A seal arrangement comprises an expandable inner tubular and an outer tubular. The inner tubular comprises an axially extending lip seal. Expansion of the inner tubular serves to energise the lip seal, a free end of which will be urged into contact with the outer tubular.

54 Claims, 4 Drawing Sheets

SEAL ARRANGEMENT

CROSS-REFERENCE TO RELATED APPLICATIONS

This application claims benefit of Great Britain patent application serial number GB 0318181.5, filed Aug. 2, 2003, which is herein incorporated by reference.

BACKGROUND OF THE INVENTION

1. Field of the Invention

This invention relates to a seal arrangement, and in particular to a seal arrangement for provision on an expandable tubular. The invention has particular utility in downhole applications.

2. Description of the Related Art

There have been numerous proposals, by the applicant and others, for arrangements for providing a seal between tubulars, where the diameter of an inner tubular is increased to bring the outer surface of the tubular into contact with the inner surface of a surrounding outer tubular. The seal may take the form of a metal-to-metal seal, or may utilise elastomer seal rings or bands of relatively soft metal.

It is among the objectives of embodiments of the present invention to provide a seal of this type, which is effective at high pressures and high temperatures.

SUMMARY OF THE INVENTION

According to the present invention there is provided a seal arrangement comprising:

an expandable inner tubular; and an outer tubular, at least one of the tubulars comprising an axially extending lip seal.

According to another aspect of the present invention there is provided a method of forming a seal between an expandable inner tubular and an outer tubular, the method comprising:

providing an axially extending lip seal on one of the tubulars; and expanding the inner tubular such that the lip seal contacts the other of the tubulars.

The expansion of the inner tubular serves to energise the lip seal, at least a free end portion of which will be urged into contact with the other of the tubulars. Thus, a fluid pressure differential acting across the seal in an axial direction opposite to the orientation of the lip seal will tend to further energise the seal. The seal may be provided between a wide range of tubular members, particularly members to be located downhole, including casing and liner, packers or metal clad. In these cases the lip seal may provide a metal-to-metal seal between the tubulars.

Preferably, the lip seal is integral with one of the tubulars, most preferably the inner tubular. Thus, the lip seal will typically be formed of the same or similar material as the tubular, typically a metal, although the lip seal may be treated to provide different material properties than other parts of the tubular. Alternatively, the seal may be in the form of a separate member.

Preferably, a plurality of lip seals are provided on said one of the tubulars. The lip seals may extend in a common axial direction, or seals may be provided which extend in opposite axial directions.

Preferably, the inner tubular describes an outer diameter and the lip seal is mounted on the inner tubular and initially describes the same or a smaller diameter, thus providing clearance between the tubulars to permit free running of the inner tubular into the outer tubular and a degree of protection for the seal. The lip seal may be provided in a channel or recess in the inner tubular formed by removing material from the outer surface of the tubular, and preferably the wall thickness of the tubular is substantially maintained at the seal location and the lip seal is accommodated within the diameter of the tubular by cutting the lip seal from a thickened wall portion or by indenting the wall of the tubular at the seal location, for example by rolling.

Expansion of the inner tubular may be achieved by any appropriate means, including fixed diameter or compliant cones or mandrels, which are axially translated through the tubing to extend the tubular wall. Preferably, the inner tubular is expanded by rotary expansion, that is by rotating an expansion device carrying an expansion member in contact with the inner wall of the tubular such that the expansion member induces compressive yield of the tubular, reducing the wall thickness with a corresponding increase in diameter. The expansion may be fluid pressure-assisted.

Preferably, the inner tubular is plastically deformed, such that the increased diameter of the tubular is retained without physical support after the expansion force is removed. The lip seal may also be plastically deformed between the tubulars. Most preferably, the lip seal has a degree of resilience and is at least elastically deformed on expansion of the inner tubular such that, following removal of the expansion force, at least a portion of the lip seal, typically the free end of the seal, is urged into sealing contact with the other tubular. The resilience may be inherent in the material forming the lip seal, or alternatively or in addition the seal may be provided in combination with a resilient element, for example a polymeric or elastomeric member provided between a portion of the lip seal and said one of the tubulars.

In one embodiment of the invention the seal arrangement may be provided in combination with a coupling or connector, and may serve to seal the coupling. The invention has particular utility in combination with threaded connectors, as on expansion conventional threaded connectors tend to lose torque and sealing capabilities. In a preferred embodiment the seal arrangement is provided in combination with a connector that is adapted to maintain or hold torque post-expansion. In this embodiment a substantially conventional threaded coupling may also be provided to provide an initial torque and pressure-tight seal. The lip seal is preferably provided on the inner tubular. The lip seal may be provided at any appropriate location, but is preferably provided towards a free or leading end of the inner tubular. The diameter of the inner tubular may be reduced at the seal location to protect the seal, provided on an external face of the tubular, when the connector is being made up.

According to a further aspect of the present invention there is provided an expandable tubular coupling comprising a first expandable tubular adapted for coupling to a second expandable tubular, at least one of the tubulars comprising an axially extending lip seal.

According to another aspect of the present invention there is provided a method of coupling expandable tubulars, the method comprising:

providing an axially extending lip seal on one of the tubulars;

coupling the tubulars; and expanding the tubulars such that the lip seal forms a sealing contact with the other of the tubulars.

The tubulars may feature male and female connector portions. The lip seal may be provided on either a male or female portion, but is preferably provided on a male connector portion. The lip seal may be provided at any appropriate location, but is preferably provided towards a free or leading end of the male connector portion. The diameter of the inner tubular may be reduced at the seal location to protect the seal when the coupling is being made up.

The coupling may be used in connecting a wide range of tubular members, particularly members to be located downhole, including casing and liner. In these cases the lip seal may provide a metal-to-metal seal between the tubulars.

Preferably, the lip seal is integral with one of the tubulars. Thus, the lip seal will typically be formed of the same or similar material as the tubular, typically a metal, although the lip seal may be treated to provide different material properties than other parts of the tubular. Alternatively, the seal may be in the form of a separate member.

Preferably, a plurality of lip seals are provided on said one of the tubulars. The lip seals may extend in a common axial direction, or seals may be provided which extend in opposite axial directions.

Expansion of the coupled tubulars may be achieved by any appropriate means, including fixed diameter or compliant cones or mandrels, which are axially translated through the tubing to extend the tubular wall. Preferably, the coupled tubulars are expanded by rotary expansion, that is by rotating an expansion device carrying an expansion member in contact with the inner wall of a tubular such that the expansion member induces compressive yield of the tubular, reducing the wall thickness with a corresponding increase in diameter. The expansion may be fluid pressure-assisted.

Preferably, on expansion of the coupling the lip seal is plastically deformed between the tubulars. Most preferably, the lip seal has a degree of resilience and is at least elastically deformed on expansion of the coupling such that, following removal of the expansion force, at least a portion of the lip seal, typically the free end of the seal, is biased into sealing contact with the other tubular. The resilience may be inherent in the material forming the lip seal, or alternatively or in addition the seal may be provided in combination with a resilient element, for example a polymeric or elastomeric member provided between a portion of the lip seal and said one tubular.

The coupling may include a threaded connector, which may be substantially conventional; the threaded connector may provide an initial torque and pressure-tight seal. In a preferred embodiment the coupling includes a torque-resisting arrangement adapted to maintain or hold torque post-expansion.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
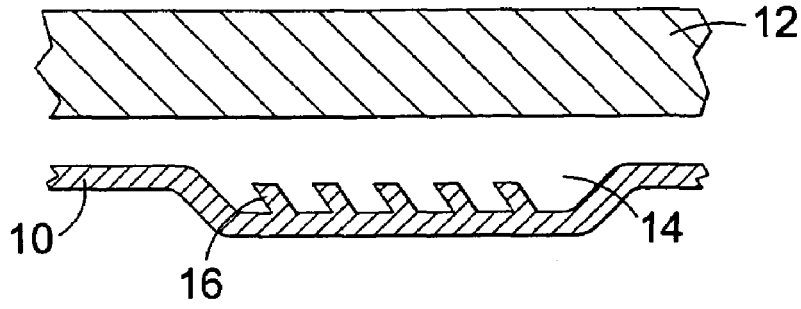
FIGS. 1, 2 and 3 are schematic illustrations showing formation of a seal between an expandable inner tubular and an outer tubular in accordance with an embodiment of the present invention.
Figure 2:
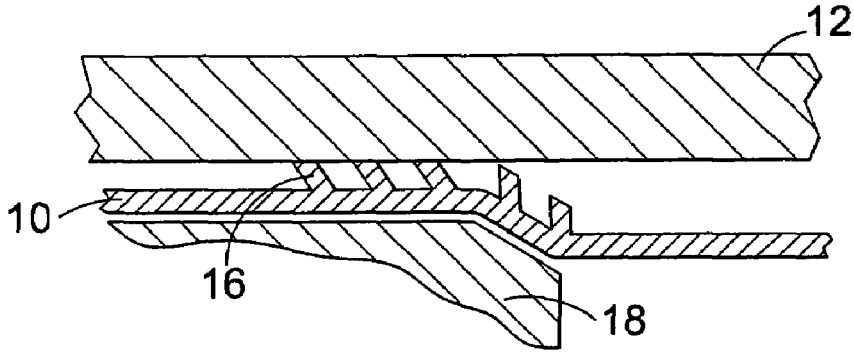
Figure 3:
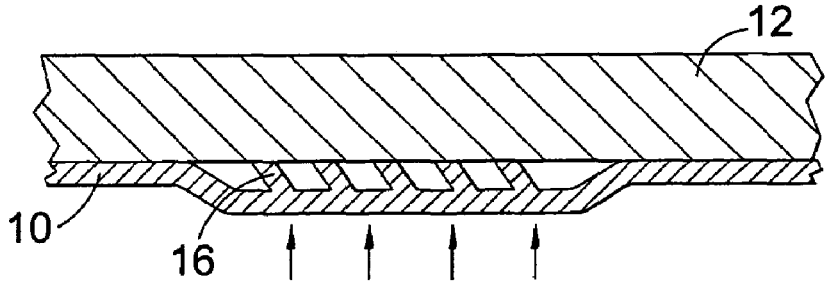

Reference is first made to FIGS. 1, 2 and 3 of the drawings, which are schematic illustrations showing formation of a seal between an expandable inner tubular in the form of a section of liner 10 and an outer tubular in the form of a section of casing 12, in accordance with an embodiment of the present invention.

The liner 10 includes a circumferential indent or channel 14. Within the channel 14 are five lip seals 16 which extend radially and axially from the floor of the channel 14. In this particular example, the liner 10 has originally been provided with a thickened wall portion which has then been cut to form the channel 14 and the seals 16. It will also be noted that with the liner 10 in the original unexpanded configuration, as illustrated in FIG. 1, the free ends of the seals 16 lie within the outer diameter of the adjacent parts of the liner 10. This serves to protect the lip seals 16 from damage when the liner 10 is run into a bore and into the casing 12.

To create the desired seal between the liner 10 and the casing 12, an expansion tool, in this case an expansion mandrel or cone 18, is run through the liner 10 as illustrated in FIG. 2. As the cone 18 is translated through the liner 10 the diameter of the liner 10 is increased. Depending upon the particular application, the diameter of the liner 10 may be increased to slightly less than or the same as the inner diameter of the casing 12, or the liner diameter 10 may be increased to an extent that the diameter of the casing 12 is also increased.

The passage of the cone 18 past the seal location causes the floor of the channel 14, and thus the lip seals 16, to be pushed out such that the free ends of the lip seals 16 are brought into contact with the inner wall of the casing 12. The lip seals 16 will be both plastically and elastically deformed and thus the free ends of the seal 16 will be urged into contact with the casting 12.

The presence of the lip seals 16 will likely cause a greater elastic recovery of the liner in the region of the seals 16 after the expansion cone 18 has passed, and this is illustrated in somewhat exaggerated form in FIG. 3 of the drawings.

Figure 4:
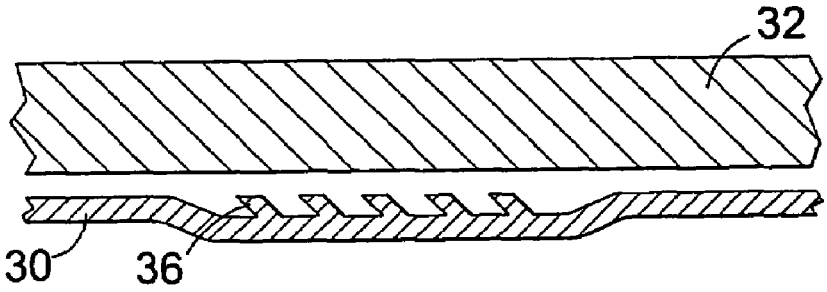
FIGS. 4, 5 and 6 are schematic illustrations showing formation of a seal between an expandable inner tubular and an outer tubular in accordance with another embodiment of the present invention.
Figure 5:
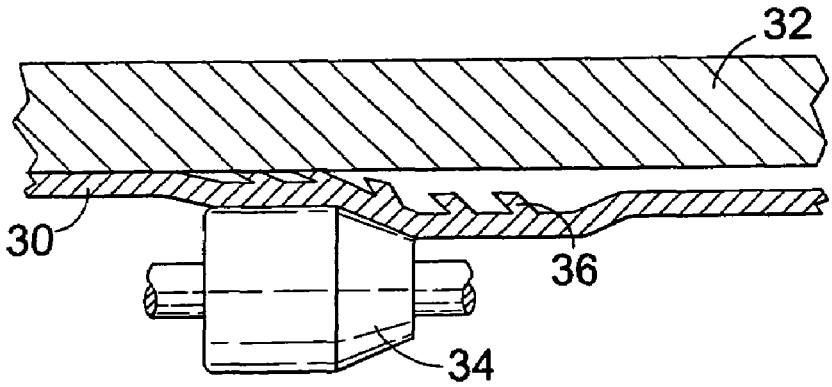
Figure 6:
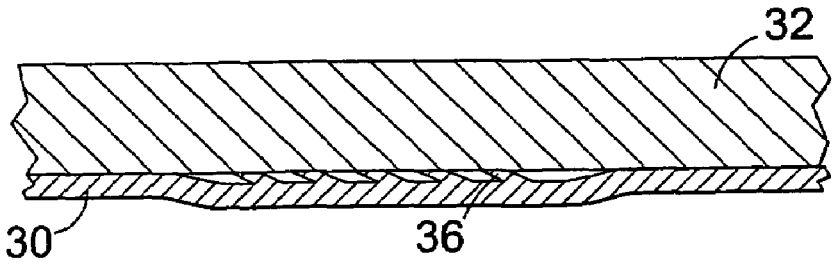

Reference is now made to FIGS. 4, 5 and 6 of the drawings which are schematic illustrations showing formation of a seal between an expandable inner tubular in the form of a liner 30 and an outer tubular in the form of casing 32. The arrangement is substantially the same as that described with respect to FIGS. 1, 2 and 3 above, however in this embodiment the expansion is achieved by means of a rotary expansion device, a roller 34 of the expansion device being shown in FIG. 5.

Due to the presence of the lip seals 36 it may not be possible to increase the inner diameter of the liner 30 in the region of the seals 36 to the same extent as the adjacent portions of liner 30, and accordingly it may be necessary to carry out the expansion of the liner 30 utilising a compliant expansion device, that is one in which the expansion members may be radially inwardly deflected.

Figure 7:
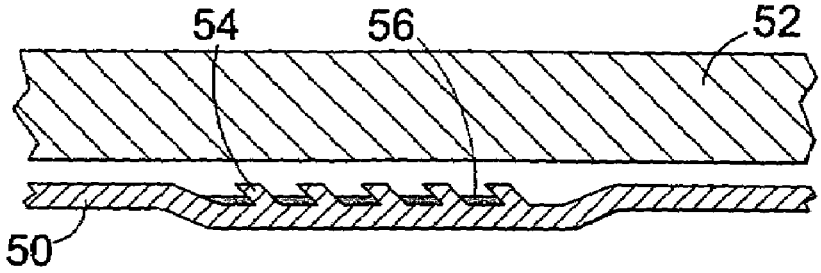
FIGS. 7, 8 and 9 are schematic illustrations showing formation of a seal between an expandable inner tubular and an outer tubular in accordance with a further embodiment of the present invention.
Figure 8:
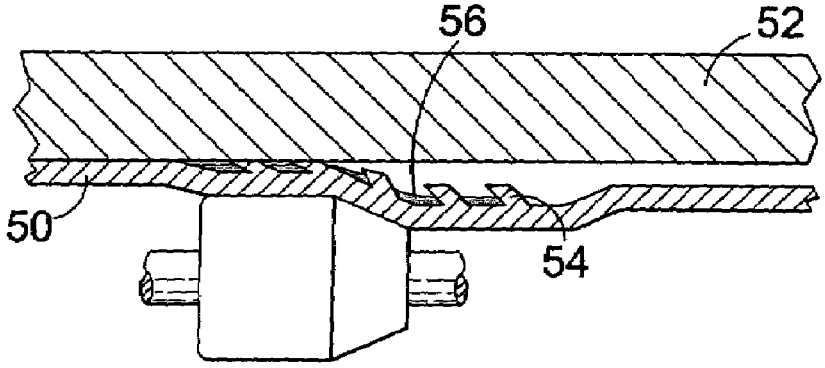
Figure 9:
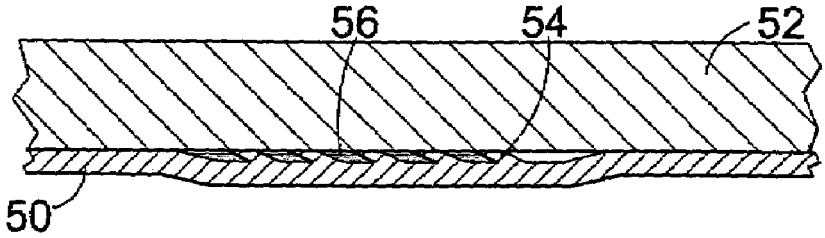

Reference is now made to FIGS. 7, 8 and 9 of the drawings, which are schematic illustrations showing formation of a seal between liner 50 and surrounding casing 52. In this embodiment the spaces between the lip seals 54 are at least partially filled with a soft metal or a polymer 56, or a mix of both. A soft metal infill will deform and flow on expansion of the liner 50 to assist in the creation of a pressure tight seal, while an elastomeric polymer infill 56 will tend to energise the deformed lip seals 56, urging the seals outwardly into sealing contact with the inner wall of the casing 52.

In the above-described embodiments it will be noted that the lip seals 16, 36, 54 are inclined from right to left as illustrated in the Figures. This seal configuration is particularly useful in resisting a fluid pressure differential between the liner casing which would act from left to right as such a pressure differential will tend to further energise the seals.

Figure 10:
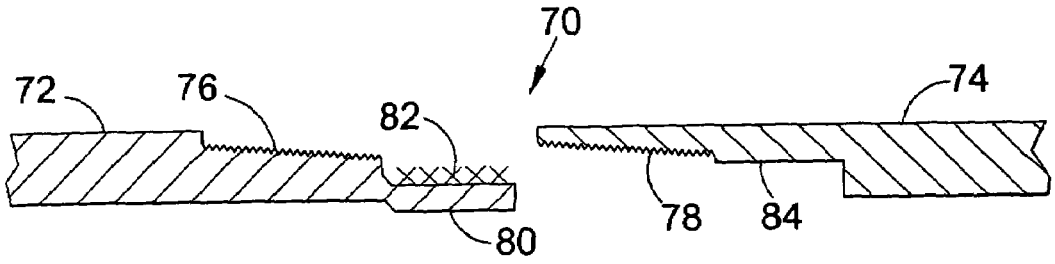
FIGS. 10, 11 and 12 are schematic illustrations showing make-up and expansion of a coupling between expandable tubulars in accordance with an embodiment of a further aspect of the present invention.
Figure 11:
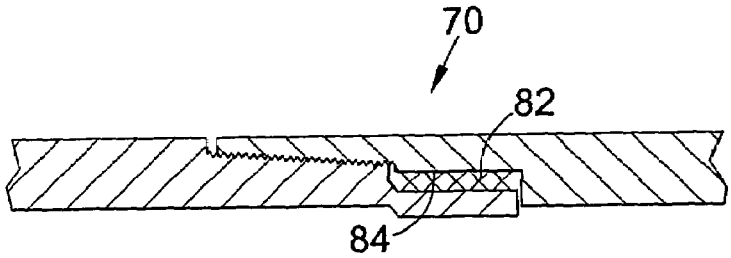
Figure 12:
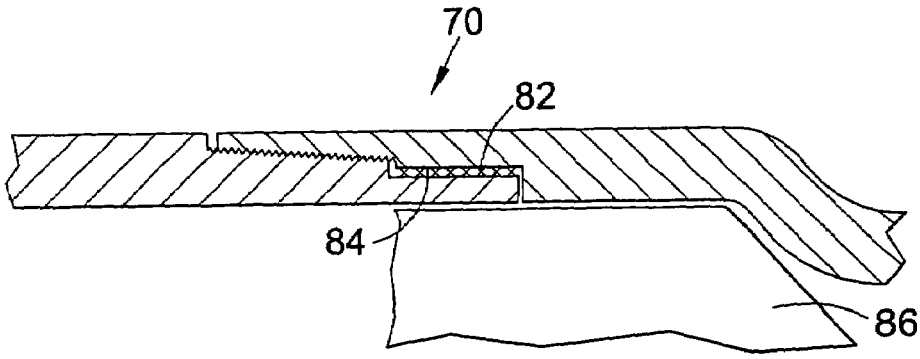

Reference is now made to FIGS. 10, 11 and 12 of the drawings which are schematic illustrations showing the makeup and expansion of a coupling 70 between expandable tubulars 72, 74 in accordance with an embodiment of a further aspect of the present invention.

The coupling 70 comprises conventional male and female threaded portions 76, 78. However, on a leading end of the male threaded portion 76 is a roll reduced portion 80 carrying a number of radially and axially extending lip seals 82. The female coupling portion 78 is provided with a corresponding high finish seal land 84 against which the free ends of the lip seals 82 are positioned when the coupling 70 is made up as illustrated in FIG. 11.

For use in coupling downhole tubulars, the coupling 70 will initially be made up on surface and the coupled tubulars then run into an appropriate downhole location.

On expansion of the coupling 70, as illustrated in FIG. 12, it is possible that the seal initially provided by the conventional threaded portion of the coupling will be lost. However, the expansion tool 86 will expand the roll reduced end portion 80 carrying the lip seals 82 such that the lip seals 82 are deformed into gas tight sealing engagement with the seal land 84. Thus the seal provided by the lip seals 82 will render the original thread seal redundant.

It will be apparent to those of skill in the art that the above-described embodiments of the various aspects of the present invention provide simple and effective sealing arrangements particularly suited for use with expandable tubulars. It will further be apparent to those of skill in the art that the above-described embodiments are merely exemplary of the present invention, and that various modifications and improvements may be made thereto without departing from the scope of the present invention.

The invention claimed is:

1. A seal arrangement comprising:

an expandable inner tubular;

an outer tubular, at least one of the tubulars comprising an axially and radially extending metal lip seal such that the lip seal is acutely inclined relative to a surface from which the lip seal extends, wherein the lip seal has a first state and a second state that forms a metal-to-metal seal between the tubulars, and wherein inclination of the lip seal relative to the surface in the first state defines a greater angle than in the second state that maintains some of the inclination.

2. The seal arrangement of claim 1, wherein seal arrangement is adapted to be located downhole.

3. The seal arrangement of claim 2, wherein at least one of the tubulars is in the form of at least one of casing, liner, a packer and metal clad.

4. The seal arrangement of claim 1, wherein the lip seal is integral with one of the tubulars.

5. The seal arrangement of claim 4, wherein the lip seal is integral with the inner tubular.

6. The seal arrangement of claim 1, wherein the lip seal is formed of the same or similar material as said one of the tubulars.

7. The seal arrangement of claim 1, wherein a plurality of lip seals are provided.

8. The seal arrangement of claim 7, wherein the lip seals extend in a common axial direction.

9. The seal arrangement of claim 7, wherein the lip seals extend in different axial directions.

10. The seal arrangement of claim 1, wherein the inner tubular describes an outer diameter and the lip seal is mounted on the inner tubular and initially describes the same or a smaller diameter.

11. The seal arrangement of claim 10, wherein the lip seal is provided in a recess in the inner tubular.

12. The seal arrangement of claim 11, wherein the wall thickness of the tubular is substantially maintained at the seal location.

13. The seal arrangement of claim 1, wherein the lip seal is plastically deformable.

14. The seal arrangement of claim 1, wherein the lip seal is elastically deformable.

15. The seal arrangement of claim 1, wherein the deformable element between a portion of the lip seal and said one tubular is a soft metal element.

16. The seal arrangement of claim 1, in combination with an expandable coupling.

17. The seal arrangement of claim 1, in combination with a threaded coupling.

18. The seal arrangement of claim 1, in combination with an expandable coupling adapted to hold torque post-expansion.

19. The seal arrangement of claim 1, wherein the lip seal is provided at or towards a free end of the inner tubular.

20. The seal arrangement of claim 1, wherein the lip seal is adapted to seal an interface between the tubulars.

21. The seal arrangement of claim 1, wherein the lip seal is disposed along a coupling between the inner and outer tubulars.

22. The seal arrangement of claim 1, wherein the lip seal is disposed along at least one of a pin end and a box end of the inner and outer tubulars, respectively.

23. The seal arrangement of claim 1, further comprising a deformable element between a portion of the lip seal and said one tubular.

24. The seal arrangement of claim 23, wherein the deformable element is recessed relative to the lip seal.

25. The seal arrangement of claim 23, wherein the deformable element between a portion of the lip seal and said one tubular is a polymeric element.

26. A method of forming a seal between an expandable inner tubular and an outer tubular, the method comprising:

providing an axially and radially extending metal lip seal on one of the tubulars such that the lip seal in an first state is acutely inclined relative to a surface from which the lip seal extends; and expanding the inner tubular to produce the lip seal in a second state such that the lip seal contacts the other of the tubulars, wherein inclination of the lip seal relative to the surface in the first state defines a greater angle than in the second state that maintains some of the inclination after the lip seal deforms to create a pressure energized seal.

27. The method of claim 26, wherein expansion of the inner tubular energises the lip seal.

28. The method of claim 26, wherein expansion of the inner tubular urges at least a free end of the lip seal into contact with the other of the tubulars.

29. The method of claim 26, wherein the expansion of the inner tubular takes place downhole.

30. The method of claim 26, wherein the lip seal provides a metal-to-metal seal between the tubulars.

31. The method of claim 26, comprising forming the lip seal by cutting material from the wall of said one of the tubulars.

32. The method of claim 26, further comprising indenting the wall of said one of the tubulars at the lip seal location.

33. The method of claim 26, further comprising mechanically expanding the inner tubular.

34. The method of claim 33, comprising mechanically expanding the inner tubular utilising a fixed diameter expansion tool.

35. The method of claim 33, comprising mechanically expanding the inner tubular utilising a compliant expansion tool.

36. The method of claim 33, comprising expanding the inner tubular by passing an expansion mandrel therethrough.

37. The method of claim 33, comprising expanding the inner tubular by rotary expansion.

38. The method of claim 26, comprising expanding the inner tubular by application of fluid pressure thereto.

39. The method of claim 26, wherein the inner tubular is plastically deformed.

40. The method of claim 26, wherein the lip seal is plastically deformed.

41. The method of claim 26, wherein the lip seal is elastically deformed.

42. The method of claim 26, further comprising energizing the lip seal with a pressure differential across the lip seal.

43. A method of coupling expandable tubulars, the method comprising:

providing an axially and radially extending metal lip seal on one of the tubulars such that the lip seal in an first state is acutely inclined relative to a surface from which the lip seal extends;

coupling the tubulars; and expanding the tubulars to produce the lip seal in a second state such that the lip seal forms a sealing contact with the other of the tubulars, wherein inclination of the lip seal relative to the surface in the first state defines a greater angle than in the second state that maintains some of the inclination after the lip seal deforms without completely compressing.

44. The method of claim 43, comprising expanding the tubulars downhole.

45. The method of claim 43, comprising mechanically expanding the tubulars.

46. The method of claim 43, comprising expanding the tubulars using a compliant expansion device.

47. The method of claim 43, comprising expanding the tubulars using a fixed diameter expansion device.

48. The method of claim 43, comprising expanding the tubulars utilising an expansion cone.

49. The method of claim 43, comprising expanding the tubulars utilising a rotary expander device.

50. The method of claim 43, comprising utilising fluid pressure to expand the tubulars.

51. The method of claim 43, comprising plastically deforming the lip seal.

52. The method of claim 43, comprising elastically deforming the lip seal.

53. The method of claim 43, comprising resiliently urging at least an end portion of the lip seal radially outwards.

54. The method of claim 43, wherein the tubulars are at least initially connected by a threaded connection.

* * * * *